United States Patent [19]

Oda et al.

[11] Patent Number: 4,978,311

[45] Date of Patent: Dec. 18, 1990

[54] ELECTRICAL CONNECTOR HAVING CONNECTOR-OPERABLE SHORTING BAR

[75] Inventors: Kenzo Oda, Hadano; Seiji Hirano, Hiroshima, both of Japan

[73] Assignee: AMP Incorporated, Harrisburg, Pa.

[21] Appl. No.: 417,220

[22] Filed: Oct. 4, 1989

[30] Foreign Application Priority Data

Oct. 27, 1988 [JP] Japan ..... 63-271654

[51] Int. Cl.[5] ..... H01R 13/703

[52] U.S. Cl. ..... 439/188; 200/51.1

[58] Field of Search ..... 439/188, 507, 511, 513, 439/515; 200/51.1

[56] References Cited

U.S. PATENT DOCUMENTS 4,179,178 12/1979 Bachman et al. ..... 439/188

FOREIGN PATENT DOCUMENTS 2903896 8/1979 Fed. Rep. of Germany ..... 439/188

*Primary Examiner*—Neil Abrams

*Attorney, Agent, or Firm*—Adrian J. LaRue; Allan B. Osborne

[57] ABSTRACT

An electrical connector comprises matable connector housings (10,20) having matable electrical contacts (21), a shorting bar (22) in one of the connector housings (20) and having sloped sections (22A, 22B) with one of the sloped sections (22B) engaging the contact (21) in the housing (20) adjacent the shorting bar (22) when the connector housings are unmated, and a push-up projection (12) on the other of the connector housings (10) and having separate push-up projections (12A, 12B) for engagement with the respective sloped sections (22A, 22B) to push up the shorting bar (22) out of engagement with the contact (21) by one of the push-up projections even if the other push-up projection is broken when the connector housings are mated.

5 Claims, 3 Drawing Sheets

ELECTRICAL CONNECTOR HAVING CONNECTOR-OPERABLE SHORTING BAR

FIELD OF THE INVENTION

The present invention relates to an electrical connector and more particularly to an improved connector for an air bag to be used for a vehicle air bag trigger circuit to protect a human body in case of collision.

BACKGROUND OF THE INVENTION

An air bag connector is a connector to be used in a trigger circuit for operating an air bag. It comprises a pair of connector housings having a pair of matable terminals. A shorting bar is provided in one of the connector housings having the terminal connected to the trigger circuit for forming a misfiring-protection circuit by short circuiting the trigger circuit when the connector housings are accidentally disconnected. A push-up projection is located on the other connector housing to push up the shorting bar for opening the misfiring-protection circuit in the case of the mating of the connectors.

An air bag is a very important system to save human life and must avoid misfiring in case of accident or collision. However, the trigger circuit is provided with a misfire protection mechanism comprising the aforementioned shorting bar to protect misfiring of the air bag by short circuiting the electrodes when the connectors are accidentally disconnected or intentionally disconnected to test the trigger circuit.

The shorting bar for the misfiring-protection circuit must assure the opening or breaking of the circuit between the electrodes by its push-up projection when the connectors are mated. If the electrodes remain at a short-circuit condition, the air bag will not be operated in case of accident.

SUMMARY OF THE INVENTION

It is, therefore, an object of this invention to provide a connector for an air bag which assures pushing up of the shorting bar when the connectors are mated, thereby avoiding misfiring of the air bag.

In a connector for an air bag comprising a pair of connector housings, one has a push-up projection to push up the shorting bar for the misfiring-protection circuit in the other connector housing when the two connectors are mated. The connector for an air bag according to the present invention has a shorting bar having two sloped sections angularly disposed to the direction of mating of the pair of connector housings to be pushed up by the push-up projection when the connector housings are mated. The push-up projection has separate projections to act on each of the two sloped sections when the pair of connector housings are mated, thereby enabling pushing up of the shorting bar even if one of the push-up projections may be broken.

It is to be noted here that the two push-up projections do not necessarily act on the two sloped sections to engage and push them up simultaneously when the connectors are mated. It simply means that one projection engages one sloped section to push up the shorting bar if the other projection is broken. That is, for example, in pushing up the shorting bar by one push-up projection engaging one of the two sloped sections, the other projection may be slightly separated from the other sloped section in such a manner that the other projection engages the other sloped section to push up the shorting bar if the one projection is broken and cannot push up the shorting bar.

The connector for an air bag according to this invention is constructed as described above. One of the projections pushes up the shorting bar even if the other projection may be broken, thereby assuring opening of the misfiring-protection circuit and preventing misfiring of the air bag in case of accident as long as the connectors are mated.

BRIEF DESCRIPTION OF THE DRAWINGS

An embodiment of the present invention will now be described hereunder by way of example with reference to the detailed following description and the accompanying drawings.

DETAILED DESCRIPTION OF THE INVENTION

Figure 1:
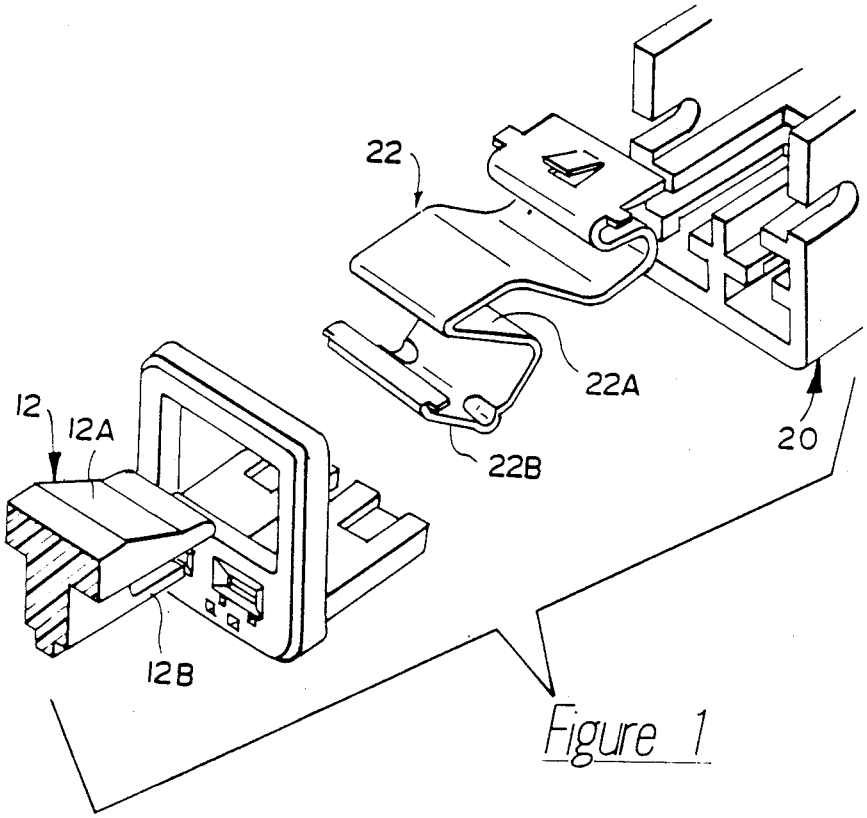
FIG. 1 is a perspective and exploded view of disassembled important parts of one embodiment of the connector for an air bag according to the present invention.

Illustrated in FIG. 1 is a perspective and exploded view of disassembled important parts of a connector for an air bag according to the present invention. Shown in FIG. 1 are a push-up projection 12 provided at the front end of a male housing and a shorting bar 22 provided at the front end of a female housing. Illustrated in FIG. 2 are the male housing 10 and the female housing 20 in a mated condition.

Figure 2:
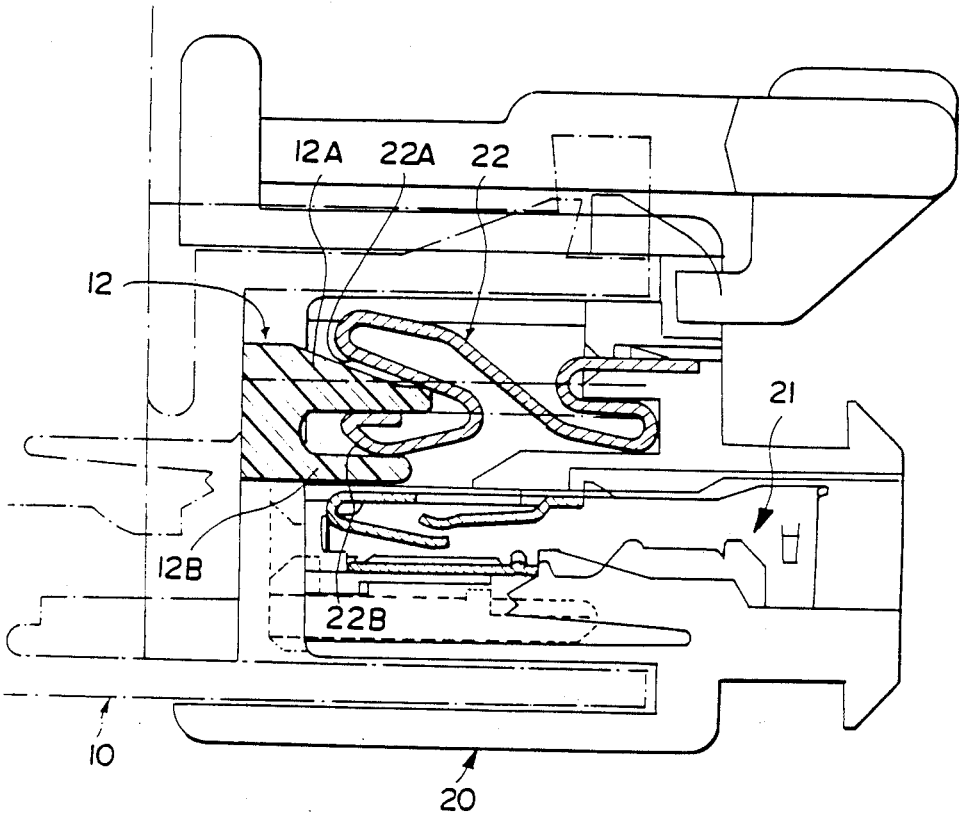
FIG. 2 is a part cross-sectional view illustrating the mated parts of the embodiment in FIG. 1.

As shown in FIG. 2, a female terminal 21 is accommodated in the male housing 20 and a male terminal (not shown) is accommodated in the male housing for making electrical connection therebetween when the connector housings are mated with each other. Additionally, the shorting bar 22 for misfiring-protection purposes is provided in the female housing 20 to form a misfiring-protection circuit by engaging the female terminal 21 in the unmated condition of the connector (see FIG. 3C).

The push-up projection 12 is part of the male housing 10. The push-up projection 12 comprises two projections, i.e., a first projection 12A and a second projection 12B at upper and lower positions in the drawing, respectively. On the other hand, the shorting bar 22 secured in the female housing 20 includes a first sloped section 22A to be pushed up by the first projection 12A when the connector is mated and a second sloped section 22B to be pushed up by the second projection 12B in the mated condition of the connector even if the first projection 12A is broken.

In other words, the air bag connector according to the present invention features the provision of two sloped sections 22A and 22B of the shorting bar 22 to be pushed up by the push-up projection 12. The sloped sections 22A, 22B are angularly disposed with respect to the mating direction of the male and female connector housings. Also, two projections 12A, 12B are provided as the push-up projection 12 to respectively engage the sloped sections 22A, 22B when the connector housings are mated, thereby enabling one push-up projection 12A or 12B to push up the shorting bar 22 even if the other push-up projection 12B or 12A may be broken.

Figure 3A:
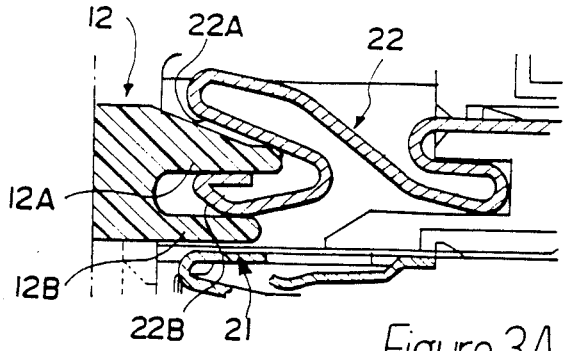
FIG. 3A is a cross-sectional view showing the normal condition when the connector is mated to push up the shorting bar to open the misfiring-protection circuit.

FIG. 3A shows the open condition of the misfiring-protection circuit in which the connector housings 10, 20 are mated with each other and the projection 12 of the male housing 10 has pushed up the shorting bar 20 in the female housing 20 to remove or disconnect it from the female terminal 21. Under this condition, the projection 12 operates in such a manner that the first projection 12A, which is longer than the second projection 12B, first engages the first sloped section 22A to push it up and then the second projection 12B follows to be inserted below the second sloped section 22B.

Figure 3B:
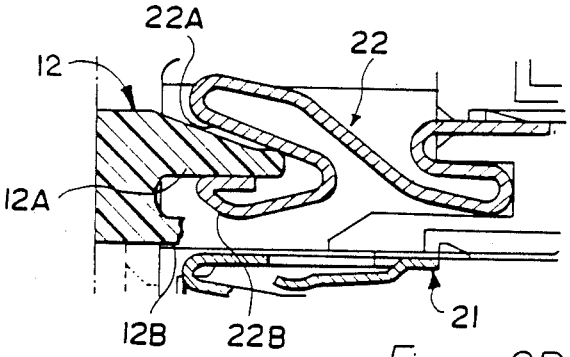
FIG. 3B is a cross-sectional view showing when the connector is mated with the second projection broken.
Figure 3C:
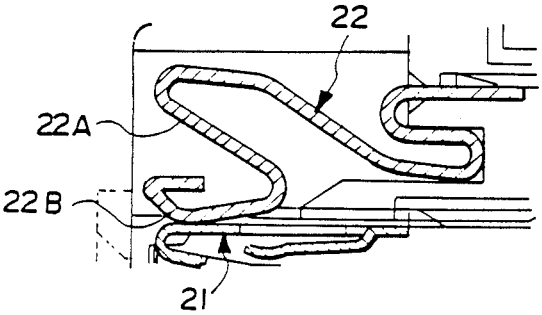
FIG. 3C is a cross-sectional view showing the shorting bar engaging the female terminal.

FIG. 3B shows an instance where the second projection 12B is broken. In this condition, the first projection 12A engages the first sloped section 22A to push it up.

It is to be understood that the second projection 12B engages the second sloped section 22B to push it up if the first projection 12A is broken.

It is, therefore, appreciated that the connector of the present invention assures pushing up of the shorting bar 22 by the push-up projection 12 and to open the misfiring-protection circuit even if either one of the projections 12A, 12B is broken. This will largely avoid any trouble of misfiring of the air bag in an accident due to a broken push-up projection, thereby assuring the air bag to operate properly. In the disclosed embodiment, the first projection 12A is longer than the second projection 12B so that the former engages first with the first sloped section 22A to push up the shorting bar 22. However, it is understood that the second projection 12B engages the second sloped section 22B to push up the shorting bar earlier than the first projection 12A. Alternatively, both projections 12A, 12B may be designed to engage the respective sloped sections 22A, 22B to push up the shorting bar 22 simultaneously.

In any event, either one of the two projections 12A, 12B will push up the shorting bar even if the other projection may be broken.

We claim:

1. An electrical connector, comprising;

matable connector housings having matable electrical contacts means;

shortening bar means secured in one of the connector housings and having first and second sloped sections, the first sloped section electrically engaging the electrical contact means in the connector housing adjacent said shorting bar means when the connector housings are unmated, the second sloped section spaced outwardly from the first sloped section;

operating means on the other of the connector housings and having first and second operating projections for engagement with the respective ones of the first and second sloped sections to move the shorting bar means out of engagement with the electrical contact means when the connector housings are mated; the operating means moving the shorting bar means from the electrical contact means even if one of the operating projections is broken.

2. An electrical connector as claimed in claim 1, wherein one of the operating projections is longer than the other of the operating projections.

3. An electrical connector as claimed in claim 1, wherein the sloped sections are angularly disposed with respect to the mating direction of the connector housings.

4. An electrical connector matable with a matable electrical connector, comprising:

a connector housing having electrical contact means secured therein for electrical connection with matable electrical contact means when said electrical connector is matable with the matable electrical connector; and shorting bar means secured in said connector housing and having first and second sloped sections angularly disposed with respect to the mating direction of the matable connectors with the first sloped section electrically engaging the electrical contact means and the second sloped section spaced outwardly from the first sloped section, the shorting bar means being moved away from the electrical contact means by first and second projections of a portion of the matable electrical connector when the matable connectors are mated or by one of the projections if the other of the projections is broken.

5. An electrical connector matable with a matable electrical connector, comprising:

a connector housing having electrical contact means secured therein for electrical connection with matable electrical contact means when said electrical connector is matable with the matable electrical connector; and operating means provided on said connector housing extending along the electrical contact means and having first and second projections for engagement with respective first and second sloped sections of a shorting bar means secured in the matable electrical connector and moving the shorting bar means away from electrical engagement with the matable electrical contact means when the matable connectors are mated or by one of the projections if the other of the projections is broken.

* * * * *